United States Patent [19]

Taylor

[11] Patent Number: 5,031,537

[45] Date of Patent: Jul. 16, 1991

[54] ELECTRICAL TIMING ARRANGEMENTS AND METHODS

[75] Inventor: Paul A. Taylor, Heston, England

[73] Assignee: Kidde-Graviner Limited, Debry, England

[21] Appl. No.: 437,540

[22] Filed: Nov. 16, 1989

[30] Foreign Application Priority Data

Nov. 18, 1988 [GB] United Kingdom ..... 88.27021

[51] Int. Cl.[5] ..... F42C 11/06

[52] U.S. Cl. ..... 102/218; 89/1.814; 89/1.812

[58] Field of Search ..... 102/206, 202, 218, 219, 102/220, 264, 216; 89/1.812, 1.814

[56] References Cited

U.S. PATENT DOCUMENTS 4,095,527 6/1978 Moore ..... 102/206
4,776,277 10/1988 Fiedler et al. ..... 102/206
4,825,765 5/1989 Ochi et al. ..... 102/217

FOREIGN PATENT DOCUMENTS 8835 3/1980 European Pat. Off. ..... 102/218
0246788 11/1987 European Pat. Off. .
2626136 12/1976 Fed. Rep. of Germany ..... 102/218
8002486 11/1980 PCT Int'l Appl. .
2195420 4/1988 United Kingdom .

*Primary Examiner*—Deborah L. Kyle
*Assistant Examiner*—Stephen Johnson
*Attorney, Agent, or Firm*—Leydig, Voit & Mayer

[57] ABSTRACT

A circuit arrangement for electrically firing a load, such as the rocket motor of a projectile, at a predetermined time after it has been ejected from a predetermined path (such as the barrel of a gun) comprises a capacitor which is charged up through bore-rider contacts sensing ejection of the projectile, a resistor and two diodes. A further diode blocks a capacitor discharge path in which the load is connected. Closure of the bore-rider contacts initiates two timers. These are of different type, so as to minimize the risk of double failure, and have the same predetermined time period. At the end of this period, they respectively close switches which abruptly shifting the potential on the positive plate of the capacitor to zero. The diode 32 in the capacitor discharge path is now unblocked and discharge current passes through the load and fires it.

15 Claims, 4 Drawing Sheets

ELECTRICAL TIMING ARRANGEMENTS AND METHODS

BACKGROUND OF THE INVENTION

The invention relates to electrical timing arrangements and methods. Timing arrangements embodying the invention and to be described in detail below have enhanced fail-safe capability. They may therefore be used in circumstances in which it is important that premature production of an output signal (that is, before the end of the present timing period) is prevented.

One particular application in which embodiments of the invention may be used relates to the firing of the rocket motor of a rocket projectile ejected from the barrel of a gun such as a hand-held gun, for examPle an anti-tank gun. In one such application, the projectile is ejected from the gun with its rocket motor in the unfired or un-energised state. It is required to fire the rocket motor only when a predetermined time has elapsed after the projectile has left the barrel of the gun. In this way, therefore, the rocket motor will not be fired until the projectile is some distance from the person holding the gun and the risk of injury to them is avoided It is of major importance to ensure that the timing of the firing is accurate. Premature firing may cause injury to the person holding the gun. Furthermore, the timing arrangement must be such that malfunction during long periods of storage will not cause false operation either during the storage or when the projectile is actually used.

SUMMARY OF THE INVENTION

According to the invention, there is provided an electrical timing circuit arrangement for energizing a load at the end of a predetermined time period, comprising capacitive means having a charging path through which the capacitive means is charged during the timing period and a discharge path via which the capacitive means is connected in series with load terminals for connection to the load, the discharge path including rectifying means which is so poled and normally so biased as to block discharge of capacitive means through the discharge path, and timing means oPerative at the end of the timing period to cause an abrupt shift in potential on the capacitive means whereby the polarity across the rectifying means is changed and the rectifying means no longer blocks the discharge path and the capacitive means discharges through the load when connected between the load terminals.

According to the invention, there is also provided an electrical timing circuit arrangement for firing a load by electrical energization thereof at a predetermined time after ejection of an object carrying the load from a predetermined path along which it initially moves, the timing arrangement being carried by the object and comprising a power supply having first and second different-polarity supply lines, capacitive means having first and second plates which are respectively connected to the first and second power supply lines through a charging path in response to operation of first switch means when the object is ejected from the predetermined path, a discharge path connecting the first and second plates of the capacitive means in series with the load and including first rectifying means poled and normally biased to block the passage of current therethrough, the charging path including second rectifying means connecting the second capacitor plate to the second power supply line and poled to permit the passage of charging current and connected in parallel with the load and the first rectifying means, first and second timing means each connected to be initiated in response to operation of the first switch means and each producing an output signal at the end of the same predetermined time period, and second switch means operative only in response to both output signals to connect the first plate of the capacitive means to the second power supply line thereby producing an abrupt shift in electrical potential on the plates of the capacitive means substantially equal to the difference in potential between the two power supply lines, thereby reversing the bias across the first rectifying means and permitting discharge of the capacitive means therethrough and thus firing the load.

BRIEF DESCRIPTION OF THE DRAWINGS

Electrical timing arrangements embodying the invention for timing the firing of a rocket motor will now be described, by way of example only, with reference to the accompanying drawings in which.

DESCRIPTION OF THE PREFERRED EMBODIMENTS

Figure 4:
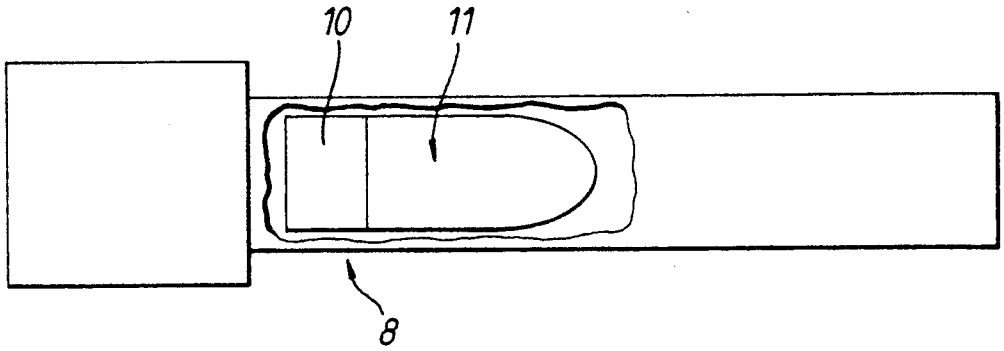

The timing arrangements to be described are for firing the rocket motor 10 (FIG. 4) of an anti-tank (or similar) projectile 11 ejected from a portable gun 8. The projectile is shot from the gun with its rocket motor un-fired. After a predetermined time has elapsed (to allow the projectile to have reached a safe distance from the operator), the rocket motor is fired by the timing arrangement. The projectile carries a "bore-rider" switch which is held in an inoperative state for so long as the projectile is contained within the bore of the gun by means of a plunger in contact with the bore When the projectile leaves the bore, however, the bore-rider switch changes over to its operative state and energises the timing arrangement in the manner to be explained.

Figure 1:
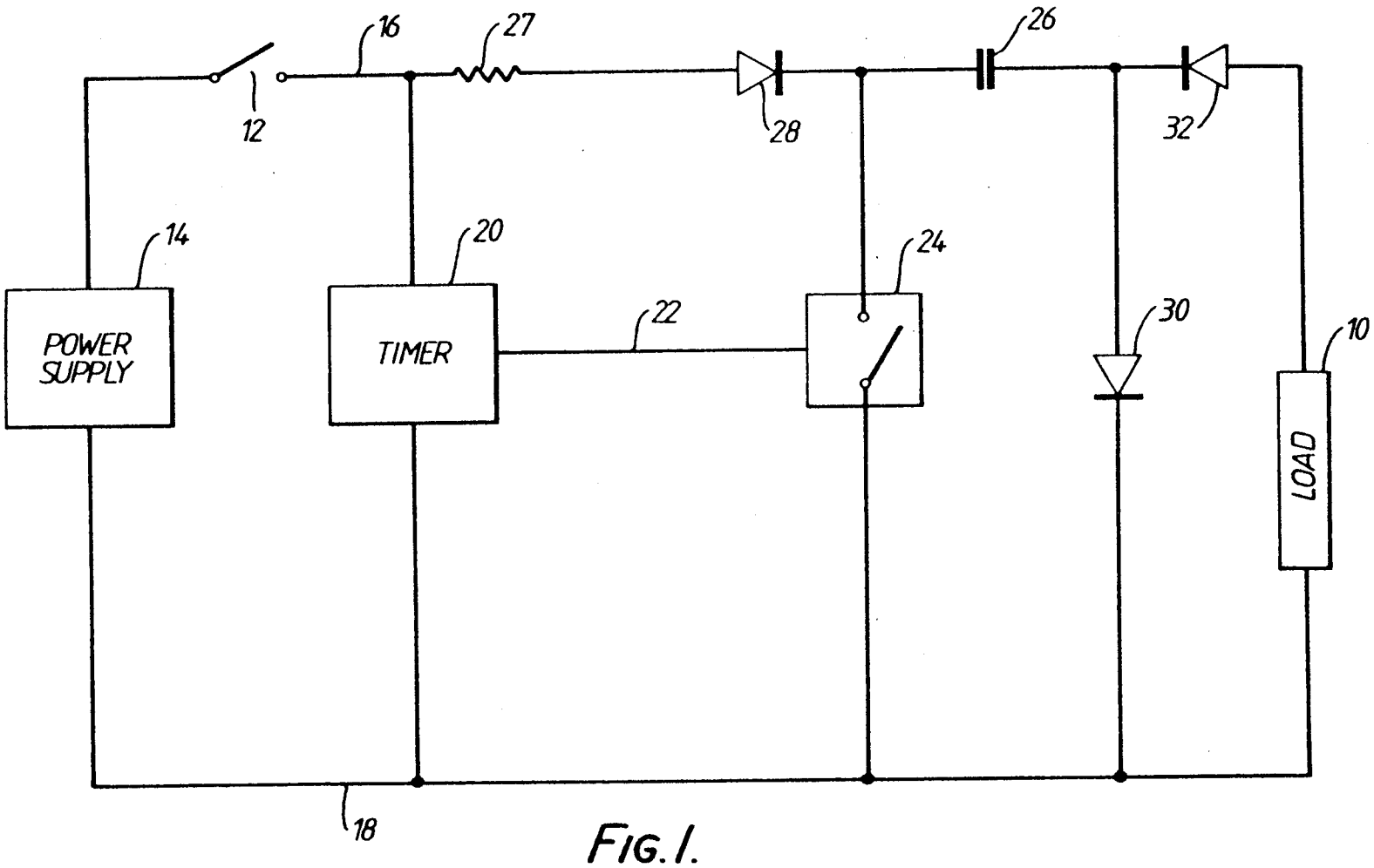
FIG. 1 is a block circuit diagram of one of the arrangements.

The rocket motor is shown in FIG. 1 at 10 and the main contacts of the bore-rider switch at 12 Closure of contacts 12 applies electrical power from a battery 14 across power supply lines 16 and 18 so as to energize a timing circuit 20. Timing circuit 20 has a timing period of 100 milliseconds in this example, at the end of which period (which starts when contacts 12 close) it produces an output signal on a line 22. This signal closes a normally-open switch 24 which may be in the form of an FET or similar device.

Closure of contacts 12 also starts to charge a storage capacitor 26 through a charging path including resistor 27, diode 28 and diode 30 Diode 32 prevents the capacitor charging current passing through the rocket motor 10.

At the end of the present timing period, timer 20 energizes the output line 22 and switch 24 is closed. It thus provides a discharge path for capacitor 26. The resultant discharge of capacitor through closed switch 24 causes a negative pulse to be generated at the cathode of diode 32 and this causes a current pulse to pass through the rocket motor 10, thus firing it. It is of course implicit in the arrangement that capacitor 26 has been sufficiently charged before the end of the 100 millisecond period.

In the arrangement illustrated, it will be noted that the discharge path for the capacitor 26 provided by closure of switch 24 produces a negative pulse so as to reverse the potential across diode 32 and to allow the capacitor to discharge through the rocket motor. This contrasts with an arrangement in which the switch 24 is connected so as to discharge the capacitor directly through the rocket motor such as by connecting the switch 24 in parallel with the diode 32. If during the inevitably long storage period for the projectile, the switch 24 develops a fault which results in its becoming closed, the effect of the latter arrangement would be to fire the rocket motor as soon as the bore-rider contacts 12 close. Such a possibility is avoided by the arrangement illustrated.

Figure 2:
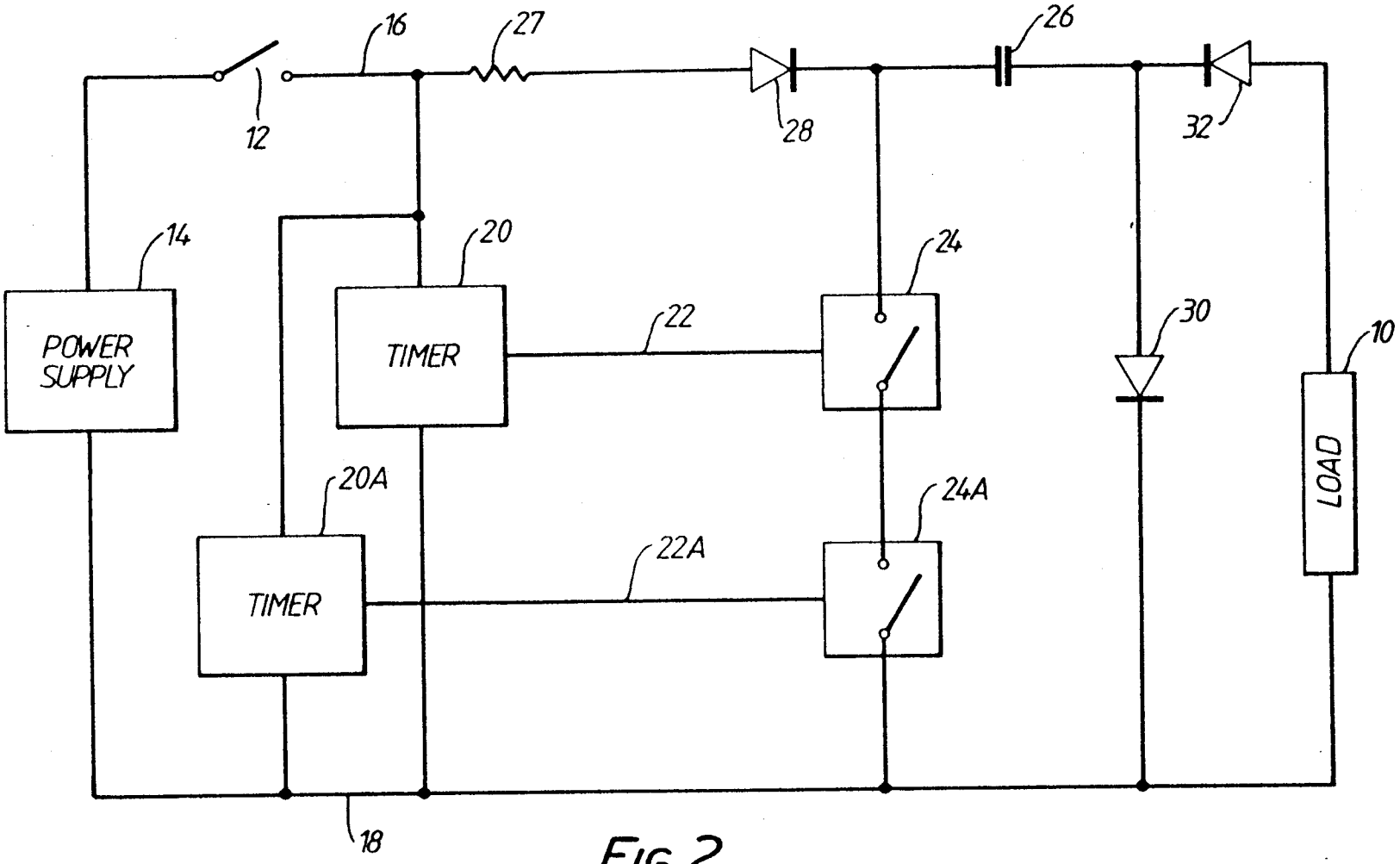
FIG. 2 shows a modified form of the arrangement of FIG. 1.

FIG. 2 shows a modified form of the circuit of FIG. 1 and corresponding items are similarly referenced. The arrangement in FIG. 2 differs in that it incorporates a second timer, timer 20A, which produces an output signal on a line 22A at the end of its predetermined period Line 22A is connected to control a normally-open switch 24A in series with and of similar type to switch 24. Timer 20A is set in operation when contacts 12 close. Both timers have the same preset time period (100 milliseconds in this example).

With the arrangement of FIG. 2, therefore, there is additional safeguard against premature firing of the rocket motor 10. The rocket motor cannot be fired until both switches 24,24A are closed. Therefore, premature closure of one of the switches, owing to a failure in its associated timer (whether during storage or during operation), will not fire the rocket motor.

An additional safeguard against premature firing of the rocket motor 10 can be obtained by arranging for the two timers 20,20A to be different in type and construction, thus reducing the chances of failure by the same mechanism.

Figure 3:
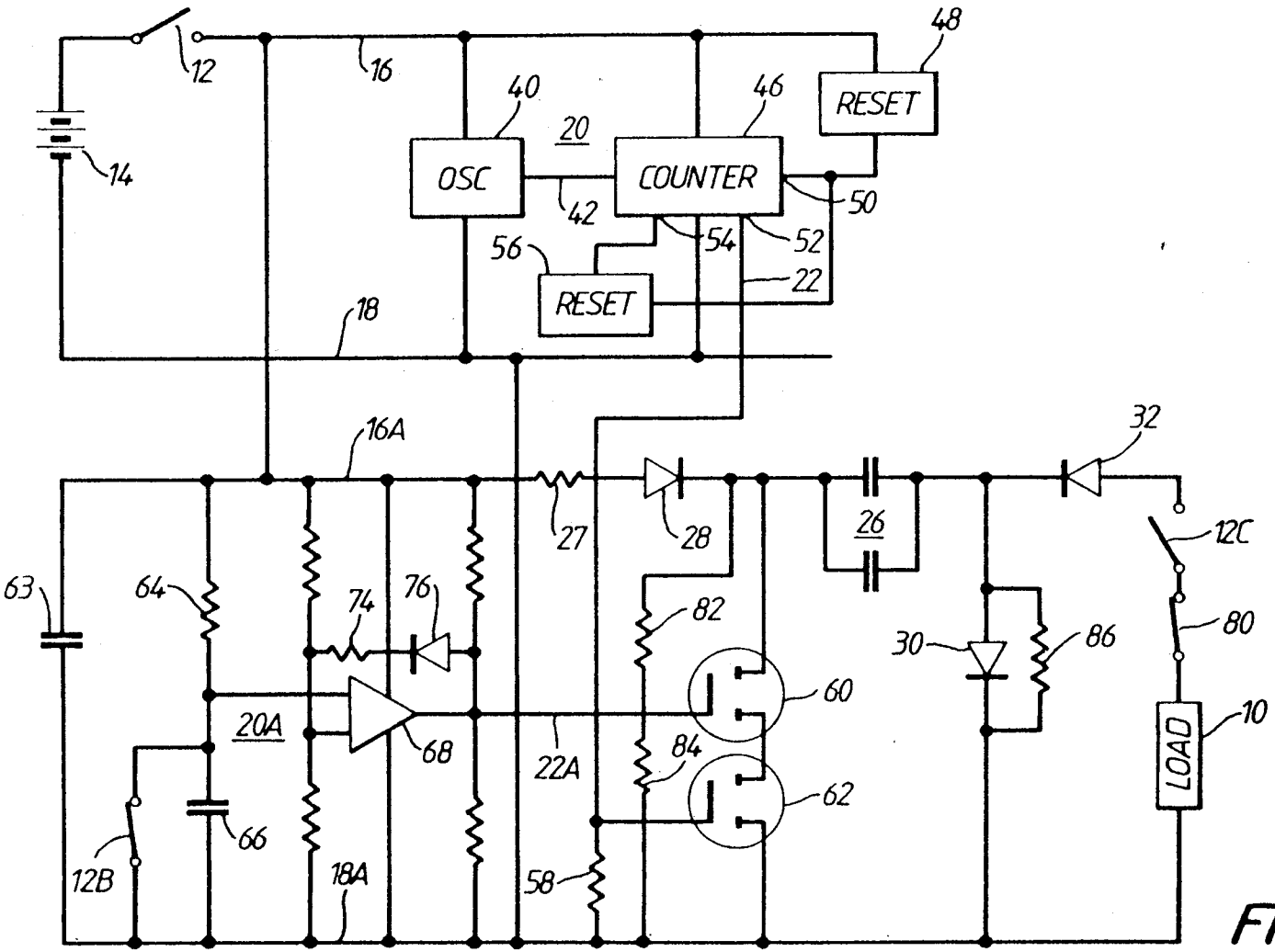
FIG. 3 is a more detailed circuit diagram of the arrangements shown in FIG. 2.

FIG. 3 shows a schematic circuit diagram of an implementation of the circuit of FIG. 2, and parts in FIG. 3 corresponding to parts in FIG. 2 are correspondingly referenced.

Referring to FIG. 3, battery 14 is in this example constituted by a thermal battery. Timer 20 is constituted by an oscillator circuit 40 which is set into operation by closure of the bore-rider contacts 12 and oscillates at a predetermined frequency of, in this example 5kHz, the oscillator being connected across the supply lines 16 and 18. The output of oscillator 40, on a line 42, is supplied to the CLOCK input of a counter unit 46 which is also connected across the supply lines 16 and 18. When bore-rider contacts 12 close, a reset unit 48 applies a pulse signal to a RESET input 50 of the counter 46 so as to reset in to zero from which value it is counted up by the CLOCK signals on line 42. At the end of 100 milliseconds, the count of counter 46 will have reached such value as to energize count output 52 which is connected to energize line 22 (see FIGS. 1 and 2). After a further 50 milliseconds, count output 54 of the counter becomes energized and, via a reset unit 56, this resets counter 46 to zero. Therefore, the operation of timer 20 is such as to energize output line 22 for a fixed period of 50 milliseconds starting 100 milliseconds after bore-rider contacts 12 are first closed.

Line 22 applies this 50 millisecond pulse across a resistor 58 and switches ON an FET 62 which constitutes switch 24 (see FIGS. 1 and 2).

FET 62 is connected in series with a second FET 60 across supply lines 16A and 18A which become energized when bore-rider contacts 12 are closed. FET 60 constitutes switch 24A (FIGS. 1 and 2). A capacitor 63 is connected across lines 16A and 18A.

Timer 20A is constituted by an R-C circuit made up of resistor 64 and capacitor 66, the voltage developed by the charge on the capacitor 66 being fed to one input of a comparator 68.

Capacitor 66 is held short-circuited by normally closed contacts 12B of the bore-rider switch When contacts 12 of the bore-rider switch are closed, contacts 12B are simultaneously opened.

After 100 milliseconds, the charge on capacitor 66 is such as to switch comparator 68 so as to produce an output on a line constituting line 22A of FIG. 3. FET 60 is therefore switched ON.

A resistor 74 and a diode 76 provide a feedback path to the positive input of comparator 68 so as to give some hysteresis and thus provide fast and positive switching of the comparator.

The charging path for the main storage capacitor 26 is via a resistor 27 and diodes 28 and 30 shown in FIGS. 1 and 2. The capacitor 26 may be constituted in practice by a capacitor bank.

In the manner already explained, closure of both FET's 60 and 62 discharges capacitor 26 and the resultant negative pulse fires the rocket motor 10 through diode 32. To provide additional safety, the energization path for load 10 is via normally open contacts 12C of the bore-rider switch and via switch 80. When the bore-rider switch operates, as a result of the projectile leaving the gun barrel, and thus (in the manner already explained) closing contacts 12 and opening contacts 12B, contacts 12C are simultaneously closed. Switch 80 is an inertia or crash switch It is normally closed but opens in the event of a premature crash of the projectile (e.g. in the event of its striking an obstacle). Thus in that event, firing of the rocket motor 10, which would be dangerous to the operator, is prevented.

High value resistors 82,84 and 86 provide a trickle discharge path so as to discharge capacitor 26 in the event of failure of one or both of the timers to operate. They will thus discharge capacitor 26 and prevent inadvertent firing of the load 10 at some later time.

As already explained, the circuit incorporates a number of safety features. In particular, the two timers 20 and 20A are of basically different type, one consisting of a counter driven by an oscillator and the other being constituted by an R-C circuit. By using two fundamentally different types of timer, the risk of simultaneous and faulty (premature) operation is considerably reduced.

Diode 28 blocks discharge of capacitor 26 in the event of a short circuit across lines 16A and 18A, such as, for example, by a short circuit in capacitor 63.

Two resistors 82 and 84 connected in series are used instead of a single resistor. If only one resistor were used, then a single component failure (shorting of this single resistor) could cause premature firing of the load.

What is claimed is:

1. An electrical timing circuit arrangement for energising a load at an end of a predetermined time period which starts with an event which ends an indeterminate quiescent period, comprising:

capacitive means having a charging path which becomes activated when the event occurs and through which the capacitive means is charged during the whole of the predetermined time period and a discharge path via which the capacitive means is connected in series with load terminals for connection to the load, the charging path excluding the load terminals and the load when connected therebetween, the discharge path including rectifying means, two-state switch means connected in circuit with the rectifying means and the capacitive means and held in one of its states throughout the quiescent period and throughout the predetermined time period and thereby to hold the rectifying means so biassed as to timing means activated when the said event occurs and defining the predetermined time period and operative at the said end thereof to switch the switch means into the other of its states and thereby cause an abrupt shift in potential on the capacitive means whereby the polarity across the rectifying means is changed and the rectifying means no longer blocks the discharge path and the capacitive means discharges through the load when connected between the load terminals.

2. An arrangement according to claim 1, in which the timing means comprises a plurality of separate timers which are arranged to assume respective predetermined states nominally simultaneously at the end of the predetermined time period and arranged such that the timing means is not rendered operative until each of the timers is in the predetermined state.

3. An arrangement according to claim 2, in which the timers are of respectively different types.

4. An arrangement according to claim 3, in which there are only two timers, one of which is of the resistance-capacitor type and the other comprises counting means connected to receive and count pulses occurring at a predetermined frequency.

5. An arrangement according to claim 1, in which:

the charging mans comprises means connecting a first plate of the capacitive means to a first one of two different-polarity power supply lines and means connecting the second plate of the capacitive means to a second one of the power supply lines, and the discharge path is connected between the second plate of the capacitive means and the second power supply line through the load terminal; and in which the switch means is connected between the first plate of the capacitive means and the second power supply line, and its said one state is an open circuit state, its said other state being a closed-circuit state such that when the switch means is switched into its closed-circuit state it abruptly connects the first plate of the capacitive means to the second power supply line.

6. An arrangement according to claim 5, in which the means in the charging path connecting the second plate of the capacitive means to the second power supply line includes further rectifying means connected in parallel with the discharge path and so poled in relation to the polarities of the first and second power supply lines as to block discharge of the capacitive means.

7. An arrangement according to claim 1 and carried by a projectile for ejection from the barrel of a gun, and in which the load comprises means for firing a rocket motor of the projectile, and in which the quiescent period comprises a period which ends upon ejection of the projectile from the barrel which is the said event, and the projectile carries means sensing ejection of the projectile from the barrel and ending the quiescent period and activating the timing means to initiate the said predetermined time period.

8. An electrical timing circuit arrangement for firing a load by electrical energisation thereof at a predetermined time after ejection of an object carrying the load from a predetermined path along which the object initially moves, the timing arrangement being carried by the object and comprising:

a power supply having first and second different-polarity supply lines having a potential difference between them, capacitive means having first and second plates which are respectively connected to the first and second power supply lines through a charging path in response to operation of first switch means when the object is ejected from the predetermined path, a discharge path connecting the first and second plates of the capacitive means in series with the load and including first rectifying means poled and biassed to prevent current in the charging path passing through the load, the charging path including second rectifying means connecting the second capacitor plate to the second power supply line and poled to permit charging current to flow and connected in parallel with the load and the first rectifying means, first and second timing means each connected to be initiated in response to operation of the first switch means and each producing an output signal when a predetermined time period ends, each predetermined time period starting upon initiation of the respective timing means and each predetermined time period being of the same time duration, and second switch means operative only in response to both said output signals to connect the first plate of the capacitive means to the second power supply line thereby producing an abrupt shift in electrical potential on the plates of the capacitive means which is substantially equal to the difference in potential between the two power supply lines and such as to reverse the bias across the first rectifying means and to permit discharge of the capacitive means therethrough and thus firing the load.

9. An arrangement according to claim 8, including third switch means connected in the discharge path and preventing firing of the load until the object has been ejected from the said predetermined path.

10. An arrangement according to claim 8, including further switch means connected in the discharge path and preventing firing of the load in response to an inertial shock to the object.

11. An arrangement according to claim 8, in which the second switch means comprises two switch means connected in series and arranged to be respectively operated by the two output signals.

12. An arrangement according to claim 8, in which the said first and second timing means are of respectively different types.

13. An arrangement according to claim 12, in which the first timing means is a resistance-capacitance type timing circuit.

14. An arrangement according to claim 12, in which the second timing circuit incorporates pulse counting means connected to receive and count pulses from a pulse source having a fixed predetermined frequency.

15. An arrangement according to claim 8, including resistance means connected to the capacitive means for providing an additional, high-resistance, discharge path therefor, this additional discharge path having a time constant such that there is no substantial discharge during each said predetermined time period.

* * * * *